United States Patent [19]

Lee

[11] 4,408,633

[45] Oct. 11, 1983

[54] HYDRAULIC CONTROL VALVE MECHANISM

[75] Inventor: Norman J. Lee, Yapton, England

[73] Assignee: Matburn (Holdings) Limited, London, England

[21] Appl. No.: 249,501

[22] Filed: Mar. 31, 1981

[30] Foreign Application Priority Data

Apr. 1, 1980 [GB] United Kingdom ..... 8010927
Dec. 9, 1980 [GB] United Kingdom ..... 8039450

[51] Int. Cl.[3] ..... F15B 13/06
[52] U.S. Cl. ..... 137/596.2; 91/420
[58] Field of Search ..... 91/420, 536; 137/596.2

[56] References Cited

U.S. PATENT DOCUMENTS 3,002,498 10/1961 Quayle ..... 91/420 X
4,012,031 3/1977 Mitchell et al. ..... 91/420 X

FOREIGN PATENT DOCUMENTS 610057 10/1948 United Kingdom ..... 137/596.2

*Primary Examiner*—Gerald A. Michalsky
*Attorney, Agent, or Firm*—McAulay, Fields, Fisher, Goldstein & Nissen

[57] ABSTRACT

A hydraulic valve for controlling a hydraulically-operated surgical table and the like comprising a body having a piston slidable in a piston chamber. Normally closed outlet check valves communicate with the chamber on opposite sides of the piston. Similarly located on each side of the piston are respective normally-closed inlet valves and relief valves. Slidable plungers are carried by the piston and may be rotated into and out of alignment with the associated check valve. In operation, the piston is rotated to align a selected plunger with an associated check valve and a fluid under pressure is introduced into the chamber on the opposite side of the piston to force the plunger against the associated check valve to open the same and permit the fluid to flow to and operate the load.

5 Claims, 3 Drawing Figures

HYDRAULIC CONTROL VALVE MECHANISM

BACKGROUND OF THE INVENTION

Figure 1:
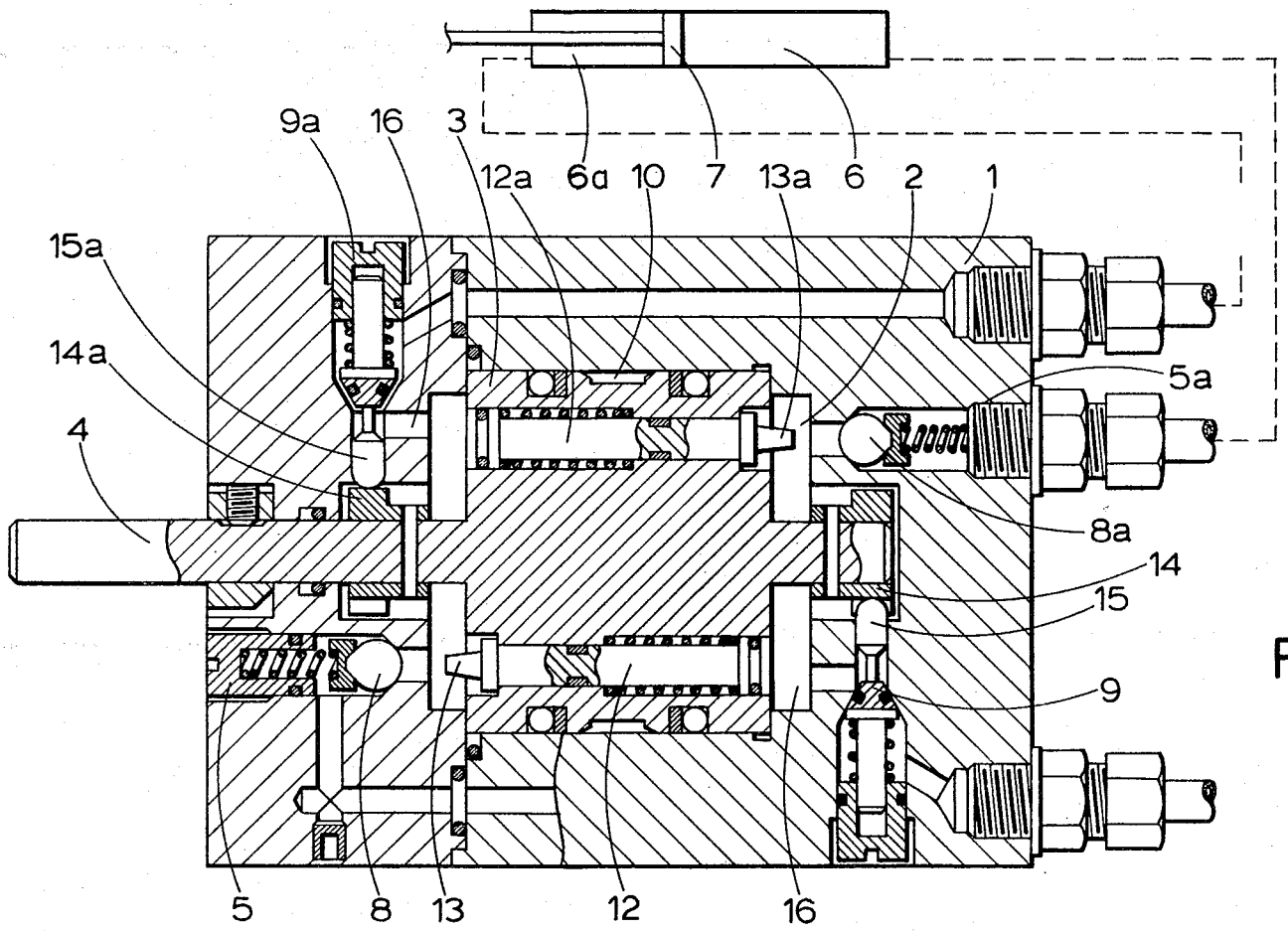

An object of the present invention is to provide a simple control valve which enables selected ones of a number of hydraulic devices to be operated as selected from a central position. In particular, the invention seeks to provide a control valve for controlling the operation of the hydraulic devices on a hydraulically operated surgical operation table although the valve is not intended to be exclusively used on or in connection with surgical operation tables.

BRIEF SUMMARY OF THE PRESENT INVENTION

A hydraulic control valve comprises a valve body having a valve chamber therein an intermediate member dividing the valve chamber into two; a plurality of control outlets leading from the valve chamber on opposite sides of the intermediate member each of the said outlets being adapted to be connected to a device to be operated by hydraulic pressure supplied from the valve chamber; a check valve located in each one of the control outlets, each said check valve being biassed to a closed position; a pair of inlet valves through which liquid can enter the valve chamber on opposite sides of the intermediate member, the said valves being biassed to a closed position; a pair of relief outlet valves leading out of the valve chamber on opposite sides of the intermediate member, and also being biassed to a closed position; a selector plunger located on each side of the intermediate member, each of the selector plungers being movable to an angular setting in which it registers with a check valve and is displaceable to open the check valve by pressure of liquid entering the valve chamber through one of the inlet valves; and means for opening a selected inlet valve whereby liquid under pressure can enter the valve chamber to displace a selector plunger registered with a check valve so as to open that check valve and permit liquid pressure to flow from a hydraulic device to be operated.

In one embodiment of the invention the intermediate member is a rotor which is mounted on a spindle extending through the valve chamber so as to be rotated in the chamber and wherein selector plungers are directed outwardly from opposite sides of the rotor, the angular setting of the selector plungers being adjusted by rotation of the rotor, and each plunger being associated with a control piston so as to be displaceable to open a check valve with which it is registered.

In another embodiment of the invention a rotatable spindle extends through the valve chamber and the intermediate member is a control piston which is axially slidable on the rotatable spindle but which is not rotatable with the spindle, a pair of selector cams is rotatable with the spindle on opposite sides of the piston, a pair of pressure plates are slidably mounted one on each side of the piston and between the piston and the adjacent selector cam, and a selector plunger is carried by each of the selector cams, the selector cams being rotatable by rotation of the spindle to open selected ones of the inlet and outlet relief valves and to register the selector plungers with selected check valves whereby liquid under pressure can enter the valve chamber to displace the piston and the adjacent pressure plate whereby the selector plunger registered with a check valve is displaced to open that check valve so that liquid pressure can flow from a hydraulic device to be operated whereby the piston will be displaced to operate the device.

BRIEF DESCRIPTION OF THE ACCOMPANYING DRAWINGS

Figure 2:
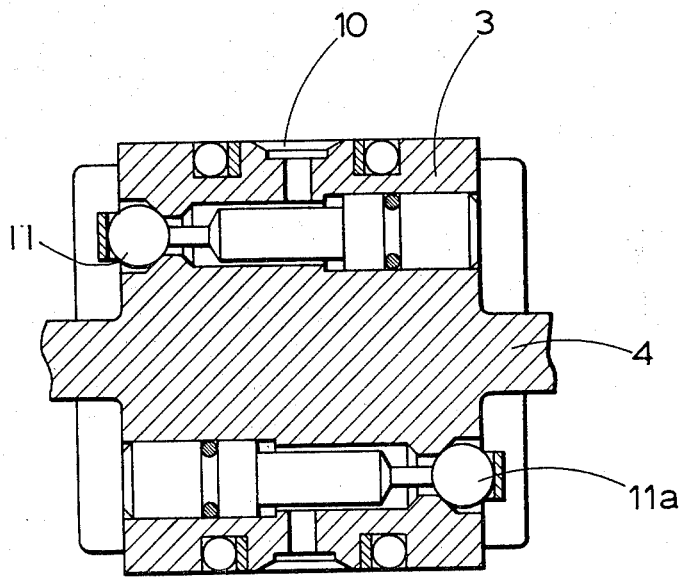
Figure 3:
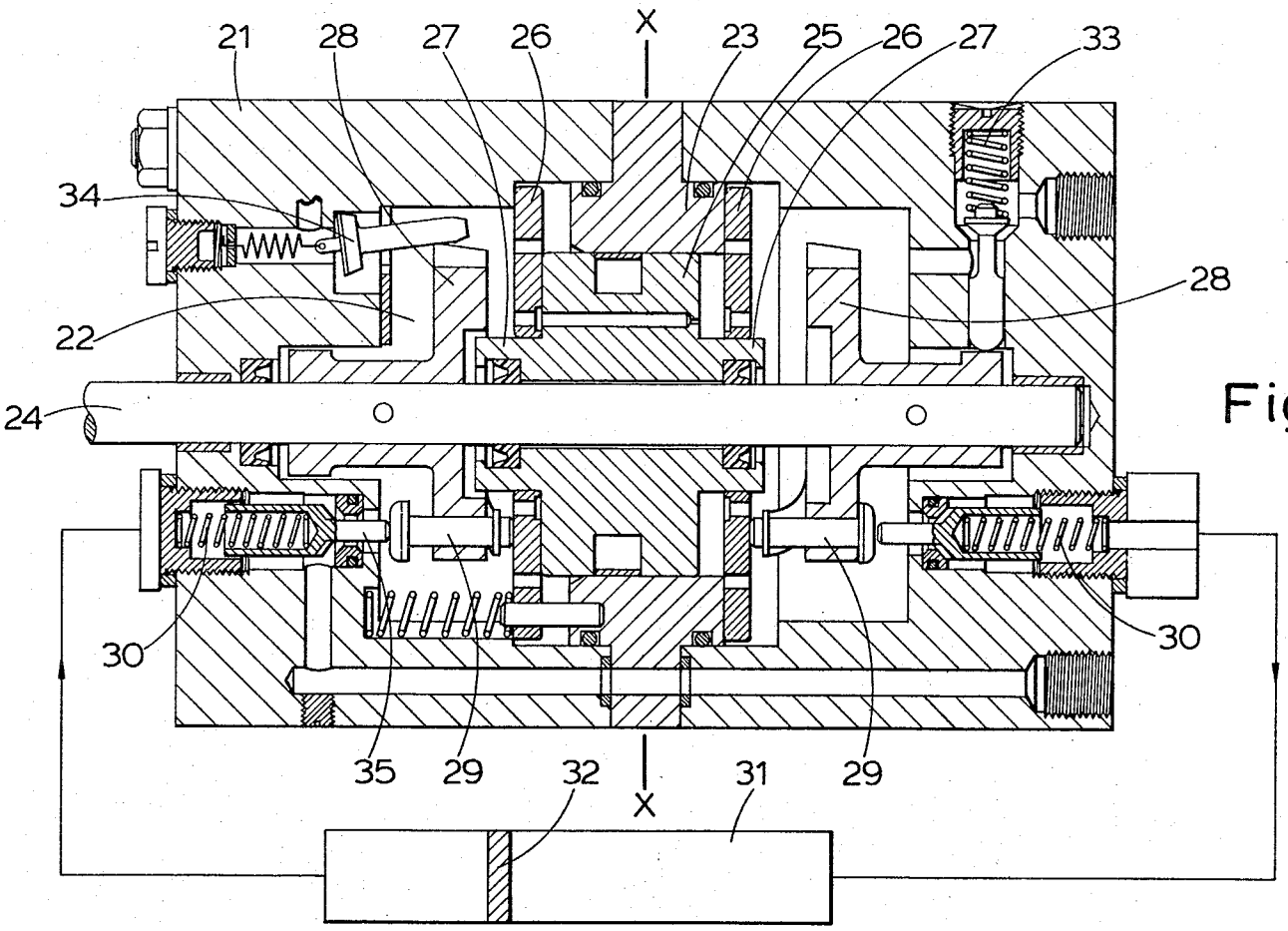

FIG. 1 is a cross-section through a central valve mechanism according to the invention;

FIG. 2 is a section through a rotor of the control valve mechanism, the section being taken in a different plane to that of FIG. 1, and FIG. 3 is a so-called random sectional view of a hydraulic control mechanism, the portion of the mechanism on the lefthand side of the line X—X being a section at a different angle from the section illustrating the portion of the mechanism on the righthand side of the line X—X.

DESCRIPTION OF SOME EMBODIMENTS OF THE INVENTION

The apparatus illustrated in FIGS. 1 and 2 of the drawings comprises a valve body 1 with a cylindrical valve chamber 2 therein. A rotor 3 is rotatable in the chamber 2 by a control knob (not shown) on one end of a spindle 4 of the rotor.

A plurality of control output ports 5, 5*a* are arranged on opposite sides of the rotor at different angular positions. Each of these control outlet ports leads to a hydraulic device to be controlled. In the embodiment illustrated, one of the control outlets (designated 5*a*) is connected to one end of a cylinder 6 containing a double acting piston 7 which is displaceable in accordance with the supply of liquid to the cylinder. Each of the control ports 5 and 5*a* has a valve member 8 or 8*a* which is spring-loaded to a closed position as shown in the drawings.

Liquid inlet valves 9 and 9*a* also lead into the valve chamber 2 on opposite sides of the rotor 3. These inlet valves 9 and 9*a* are interconnected and are both spring-loaded to a closed position illustrated in the drawings.

The rotor 3 has an annular channel 10 which communicates with two exhaust valves 11 and 11*a* (FIG. 2). These exhaust valves 11 and 11*a* open on opposite sides of the rotor 3. These exhaust valves 11 and 11*a* are spring-loaded to a closed position as illustrated in the drawings. When the exhaust valves 11 or 11*a* are open, liquid from the chamber 2 can exhaust into the channel 10 in the rotor and thence through a port (not shown in drawing) to a reservoir (not shown).

The rotor 3 also has two control or selector pistons 12 and 12*a* associated with control push rods or plungers 13 and 13*a* respectively directed outwardly from opposite sides of the rotor. These push rods or plungers 13 and 13*a* are arranged so that they register with the control or check valves 8 or 8*a* respectively of the control outlet ports 5 and 5*a* respectively. The particular valves 8 and 8*a* with which the plungers 13 and 13*a* are registered at any one time depends on the angular setting of the rotor 3.

The spindle 4 of the rotor also carries cams 14 and 14*a* on opposite sides of the rotor. These cams operate push members 15 and 15*a* associated with the inlet valves 9 and 9*a*. Rotation of the cams 14 or 14*a* open the inlet valves 9 or 9*a* against the action of their spring loading. The cams are so arranged that only one inlet valve is open at a time.

In operation, the rotor 3 is rotated to select the hydraulic device to be operated, this, in the example illustrated, being the piston 7. In so doing, the inlet valve 9 is opened, the valve 9*a* being shut, so that liquid is pumped into the valve chamber 2. The appropriate exhaust value 11 will then automatically open under the pressure of liquid in the valve chamber 2. The appropriate one of the pistons 12 with then be displaced so that its push rod or plunger 13 will displace the valve member 8 registered therewith to open the control port 5 and permit liquid to flow from the lefthand side 6*a* of the cylinder 6. Pressure in chamber 2 will therefore open valve 8*a* and port 5*a* and permit liquid to flow to the righthand side of the cylinder 6 thereby to displace the piston 7.

When pressure to the chamber 2 ceases, a "bleed" in the supply line acts as a delay. The pressure in the chamber 2 will then reduce to atmospheric and the various pistons will then return to their initial or normal positions under their respective spring loadings allowing the control valves 8 or 8*a* to close. Both sides of the piston 7 are locked. When the inlet selector cams 14 or 14*a* are returned to their original position the inlet valves 9 or 9*a* are closed.

In the embodiment illustrated in FIG. 3, a hydraulic control valve mechanism comprises a valve body 21 with a cylindrical valve chamber 22 therein. The valve chamber 22 contains a central housing or liner 23. A rotatable spindle 24 extends through the valve body 21. The spindle 24 is rotatable by a control knob or handle (not shown) outside the valve body 21.

A piston 25 is slidable on, but is not rotatable with, the spindle 24 and is axially displaceable lengthwise of the central housing or liner 23.

Pressure plates 26 are axially slidable on bosses 27 of the piston, one pressure plate 26 being provided on each side of the piston 25. Movement of the pressure plates 26 towards the centre of the valve chamber 22 is limited by engagement with the central housing or liner 23.

Two selector cams 28 are mounted on, and are rotatable with, the spindle 24, one on each side of the piston 25. As will be seen, one of the pressure plates 26 is located between each selector cam 28 and the piston 25. Rotation of the spindle 24 adjusts the angular setting of the cams 28. These selector cams 28 each carry one or more tappets or selector plungers 29 which extend through, and are axially slidable in, bores in the selector cams 28. The tappets or plungers 29 are displaceable towards the adjacent end of the valve body 21 by movement of the pressure plates 26 in a manner to be hereinafter described.

A plurality of control outlets lead out of the ends of the valve chamber 22. A check valve 30 is located in each one of these control outlets. Only two of the check valves 30 are visible in the drawing. These check valves 30 are arranged in each of the two end walls of the valve body 21 at different angular positions. Each check valve 30 is spring-loaded to a closed condition. Each of the check valves 30 is connected to a hydraulic device to be controlled. Each such hydraulic control device is connected to two check valves located on opposite sides of the piston. The two check valves 30 visible in the drawing are connected to opposite sides of a cylinder 31 containing a double-acting piston 32 which is displaceable in accordance with the supply of liquid under pressure to the cylinder 31.

A pair of inlet valves 33 lead into the valve chamber 22 on opposite sides of the piston 25. Only the valve 33 on the righthand side of the piston 25 is visible in the drawing. A pair of relief outlet valves 34 lead out of the valve chamber 22 one on each side of the piston 25. Only the valve 34 on the lefthand side of the piston 25 is visible in the drawing. These valves 33 and 34 are also spring-loaded to a closed position. In a particularly convenient arrangement, the device is provided with eight check valves 30, four on each side of the piston 25, with two tappets or selector plungers 29, one on each side of the piston 25 and, of course, with two inlet valves 33 and two relief outlet valves 34, each of which is located on each side of the piston 25.

In operation of the device, the spindle 24 is rotated to select the hydraulic device (such as 31, 32) to be operated, the selection of the device being determined by the particular angular setting of the selector cams 28. When the selector cams 28 have been given the desired angular setting, the tappets or selector plungers 29 are registered with the appropriate check valves 30 as illustrated in the drawing. The rotation of the selector cams 28 also opens the selected ones of the relief outlet valves 34. With the parts in the position illustrated in the drawing, both of the valves which are visible are open so that the two valves which are not visible are closed. With the opening of the outlet valve 34, liquid under pressure from the source of supply can enter through the valve 33 into the valve chamber 22 on the righthand side of the piston 25 since the valve is opened by the selector cam 28. The liquid entered through the valve 33 displaces the piston 25 towards the left until it assumes the position which is illustrated in the drawings.

Since the tappets or plungers 29 are registered with the appropriate check valves 30, the displacement of the piston 25 to the left will displace the pressure plate 26 on the left hand side of the drawing towards the left of the drawing. During such displacement it will engage an end of the lefthand tappet or selector plunger 29 and advance that tappet or selector plunger so that it engages a stem 35 of that check valve and moves it to a position to open the valve thereby permitting liquid from the lefthand side of the cylinder 31 to enter the lefthand side of the valve chamber 22 through that check valve 30 as shown by the arrow in the drawings. The pressure of liquid on the righthand side of the piston 25 builds up sufficiently to displace the other check valve 30 against the action of its spring so that liquid under pressure can exit through that valve 30 in the direction of the arrow to the righthand side of the cylinder 31 thereby to displace the piston 32 to the left. Thus, the hydraulic device is operated.

When pressure to the chamber 22 ceases, a "bleed" on the supply line acts as a delay. The pressure in the chamber 22 will then reduce to atmospheric and the piston will then return to its initial or normal position under its respective spring loadings allowing the check valves 30 to close. Both sides of the piston 32 are locked. When the selector cams 28 are returned to their original position the relief and inlet valves 34, 33 are closed.

I claim:

1. A hydraulic control valve comprising a valve body having a valve chamber therein an intermediate member dividing the valve chamber into two; a plurality of control outlets leading from the valve chamber on opposite sides of the intermediate member each of the said outlets being adapted to be connected to a device to be operated by hydraulic pressure supplied from the valve chamber; a check valve located in each one of the control outlets, each said check valve being biased to a closed position; a pair of inlet valves through which liquid can enter the valve chamber on opposite sides of the intermediate member, the said valves being biassed to a closed position; a pair of relief outlet valves leading out of the valve chamber on opposite sides of the intermediate member, and also being biassed to a closed position; a selector plunger located on each side of the intermediate member, each of the selector plungers being movable to an angular setting in which it registers with a check valve and is displaceable to open the check valve by the pressure of liquid entering the valve chamber through one of the inlet valves; and means for opening a selected inlet valve whereby liquid under pressure can enter the valve chamber to displace a selector plunger registered with a check valve so as to open that check valve and permit liquid pressure to flow from a hydraulic device to be operated.

2. A valve as claimed in claim 1, wherein the intermediate member is a rotor which is mounted on a spindle extending through the valve chamber so as to be rotated in the chamber and wherein selector plungers are directed outwardly from opposite sides of the rotor, the angular setting of the selector plungers being adjusted by rotation of the rotor, and each plunger being associated with a control piston so as to be displaceable to open a check valve with which it is registered.

3. A valve as claimed in claim 2, wherein the spindle carries cams on opposite sides of the rotor, the said cams bearing on push rods displaceable by the cams selectively to open the said inlet outlet valves.

4. A valve as claimed in claim 1, wherein a rotatable spindle extends through the valve chamber and the intermediate member is a control piston which is axially slidable on the rotatable spindle but which is not rotatable with the spindle, a pair of selector cams is rotatable with the spindle on opposite sides of the piston, a pair of pressure plates are slidably mounted one on each side of the piston and between the piston and the adjacent selector cam, and a selector plunger is carried by each of the selector cams, the selector cams being rotatable by rotation of the spindle to open selected ones of the inlet and outlet relief valves and to register the selector plungers with selected check valves whereby liquid under pressure can enter the valve chamber to displace the piston and the adjacent pressure plate whereby the selector plunger registered with a check valve is displaced to open that check valve so that liquid pressure can flow from a hydraulic device to be operated whereby the piston will be displaced to operate the device.

5. A valve as claimed in claim 4, wherein at least one selector plunger extends through, and is axially slidable in, a bore in each selector cam, the said plungers being axially displaceable to open the check valve by displacement of the pressure plates caused by sliding movement of the piston resulting from the entry of liquid under pressure through one of the inlet valves.

* * * * *